US006354878B1

(12) United States Patent
Kropa et al.

(10) Patent No.: US 6,354,878 B1
(45) Date of Patent: Mar. 12, 2002

(54) ELECTRICAL CONNECTOR WITH INTERCHANGEABLE FERRULE

(75) Inventors: Wayne T. Kropa, Clarks Summit; Raymond A. Busacco, Lake Arial, both of PA (US)

(73) Assignee: Berg Technology, Inc., Etters, PA (US)

( * ) Notice: Subject to any disclaimer, the term of this patent is extended or adjusted under 35 U.S.C. 154(b) by 0 days.

(21) Appl. No.: 09/437,349

(22) Filed: Nov. 9, 1999

(51) Int. Cl.[7] ..... H01R 9/03
(52) U.S. Cl. ..... 439/610
(58) Field of Search ..... 439/579, 607, 439/610

(56) References Cited

U.S. PATENT DOCUMENTS

| | | | | |
|---|---|---|---|---|
| 3,678,447 A | | 7/1972 | Ziegler, Jr. et al. | |
| 3,885,849 A | | 5/1975 | Bailey et al. | |
| 3,926,499 A | | 12/1975 | Bailey et al. | |
| 4,605,276 A | * | 8/1986 | Hasircoglu | 339/176 |
| 4,715,827 A | * | 12/1987 | Furman | 439/465 |
| 4,834,487 A | | 5/1989 | Abendschein et al. | 350/96.2 |
| 5,083,929 A | * | 1/1992 | Dalton | 439/98 |
| 5,153,911 A | | 10/1992 | Smith | 379/399 |
| 5,199,903 A | | 4/1993 | Asick et al. | 439/610 |
| 5,217,392 A | * | 6/1993 | Hosler, Sr. | 439/585 |
| 5,244,415 A | | 9/1993 | Marsilio et al. | 439/610 |
| 5,348,494 A | * | 9/1994 | Falossi et al. | 439/362 |
| 5,831,815 A | * | 11/1998 | Miller et al. | 361/679 |
| 5,890,930 A | | 4/1999 | Gerow | 439/651 |
| 5,964,620 A | * | 10/1999 | Takahashi et al. | 439/579 |
| 6,007,385 A | * | 12/1999 | Wu | 439/610 |
| 6,036,543 A | * | 3/2000 | Panis et al. | 439/607 |
| 6,105,232 A | * | 8/2000 | Malone et al. | 29/434 |

FOREIGN PATENT DOCUMENTS

GB 2330250 4/1999

* cited by examiner

*Primary Examiner*—Brian Sircus
*Assistant Examiner*—Thanh-Tam Le
(74) *Attorney, Agent, or Firm*—Perman & Green, LLP

(57) ABSTRACT

A method for manufacturing an electrical connector comprising the steps of providing an electrical connector shell, and selecting a ferrule. The electrical connector shell has a chamber for holding an electrical contact housing therein. The shell has a cable exit section allowing an electrical cable terminating in the electrical contact housing to exit the shell through the cable exit section. The selected ferrule is placed in the cable exit section of the shell. The selected ferrule is selected from different ferrules in accordance with a predetermined characteristic of the electrical connector.

22 Claims, 4 Drawing Sheets

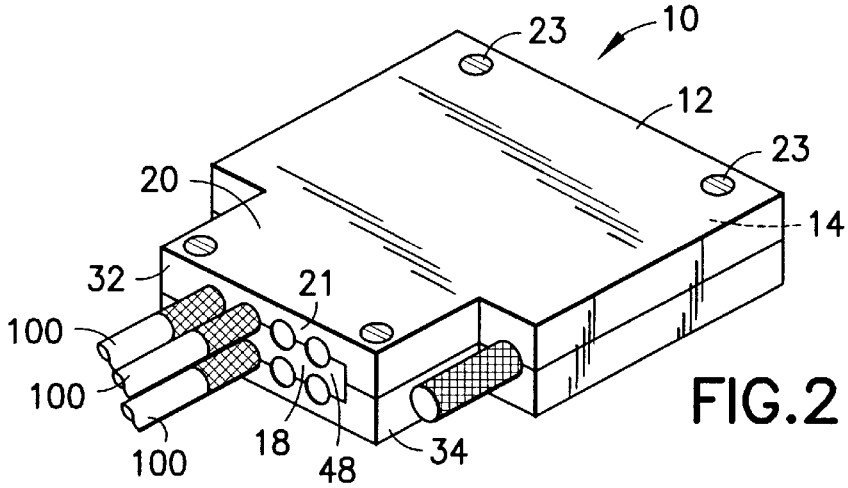
FIG.2
FIG.3A
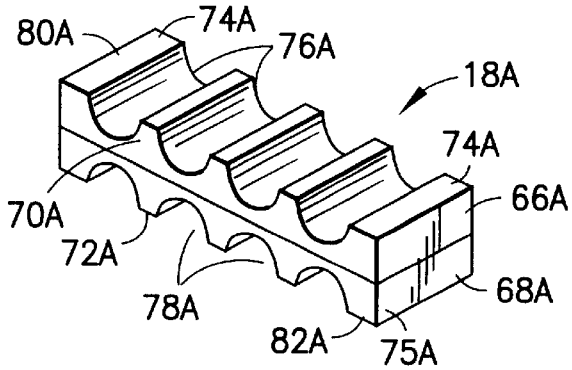
FIG.3B
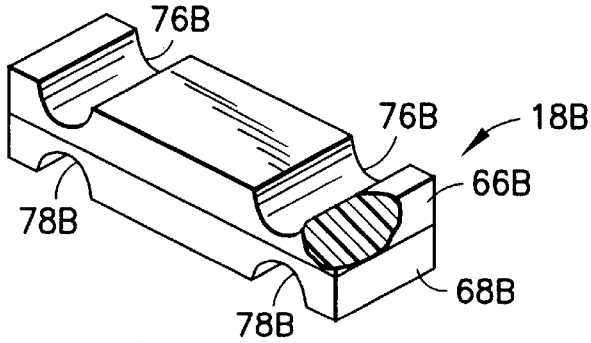
FIG.3C
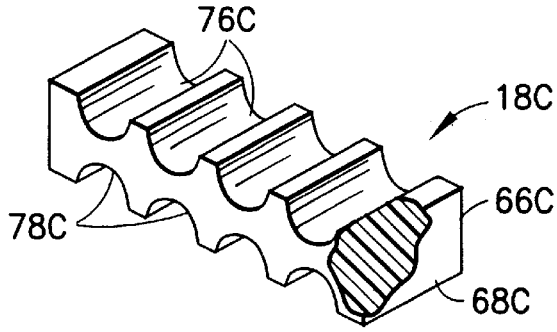

ELECTRICAL CONNECTOR WITH INTERCHANGEABLE FERRULE

BACKGROUND OF THE INVENTION

1. Field of the Invention

The present invention relates to electrical connectors and, more particularly, to electrical connectors having an interchangeable ferrule at the exit end of the connector housing to accommodate various exit cable configurations.

2. Brief Description of Earlier Developments

In the conventional art, electrical cable connectors used for connectorized cable connections have a generally customized configuration, especially at the interface between the connectors and cables terminating within the connectors (i.e. cable exit). U.S. Pat. No. 5,199,903 discloses one example of a conventional connector wherein a back shell assembly with two back shell members latched together about a connector. Each back shell member has a strain relief member crimped onto a cable terminating in the connector. Another example is disclosed in U.S. Pat. No. 5,244,415 wherein a shielded electrical computer cable connector has a shield base and a shield cover forming a shielded chamber, with a cable received at one end of the shielded chamber. As evident by the above examples, in the conventional connectors, the contact (e.g. pins or receptacles) patterns at the front end of electric cable connectors are generally standardized. However, the configuration of the rest of the connector, especially at the cable exit, varies greatly depending on factors such as the number of cables terminating in the connector, whether the connector is shielded or unshielded, or whether the connector incorporates some means of cable strain relief.

Accordingly, the back shells and other components of conventional electrical cable connectors are customized to accommodate the different cable exit configuration. Hence, a family of conventional cable connectors having substantially the same contact interface pattern, nevertheless are provided with different back shells and/or cable exit components. The lack of commonality between electrical cable connectors, even within the same family of connectors, results in different connector parts (e.g. connector back shells) being produced for performing substantially the same function. This in turn drives up the cost of the conventional connectors by limiting the cost reduction benefits from economies of scale. Furthermore, the limited use for each different part, only for connectors having a characteristic compatible with that type of part, complicates manufacture of the cable connectors, increases the time in which the connector is fabricated and raises inventory costs. The present invention overcomes the problems of these connectors as will be further described below.

SUMMARY OF THE INVENTION

In accordance with a first method of the present invention, a method for manufacturing an electrical connector is provided. The method comprises the steps of providing an electrical connector shell, and selecting a ferrule to be placed in the shell. The electrical connector shell has a chamber for holding an electrical contact housing therein. The shell has a cable exit section allowing an electrical cable terminating in the electrical contact housing to exit the shell through the cable exit section of the shell. The selected ferrule is placed in the cable exit section of the shell. The selected ferrule is selected from different ferrules in accordance with a predetermined characteristic of the electrical connector.

In accordance with a second method of the present invention, a method for fabricating an electrical connector is provided. The electrical connector has a shell holding therein an electrical contact housing for terminating an electrical cable. The method comprises the steps of providing the shell with a cable exit section, selecting a ferrule, and installing the selected ferrule in the cable exit section of the shell. The electrical cable terminating in the electrical contact housing exits the shell through the cable exit section. The ferrule is selected in accordance with a predetermined characteristic of the electrical connector from at least one of a strain relief ferrule, a single cable exit ferrule, a multiple cable exit ferrule, a shielding ferrule, or a non-conductive ferrule.

In accordance with a first embodiment of the present invention, an electrical connector is provided. The electrical connector comprises a shell having a chamber with a contact housing disposed therein. The contact housing is adapted for terminating a conductor of a cable connected to the shell. The shell has a cable exit section through which the cable exits the shell. The electrical connector has an interchangeable ferrule part held in the cable exit section of the shell. Different interchangeable ferrule parts are used for different cable exit configuration of the connector.

In accordance with the second embodiment of the present invention, an electrical connector is provided. The electrical connector comprises an outer shell, an electrical contact housing, and a ferrule part. The electrical contact housing is located in the outer shell at a connecting end of the outer shell. The shell has a cable exit section at a back end of the shell wherein an electrical cable terminating in the electrical contact housing exits the shell through the cable exit section. The ferrule part is held in the cable exit section of the shell. The ferrule part held in the cable exit section is selected from different ferrule parts in accordance with a predetermined characteristic of the electrical connector.

BRIEF DESCRIPTION OF THE DRAWINGS

The foregoing aspects and other features of the present invention are explained in the following description, taken in connection with the accompanying drawings, wherein:

FIG. 2 is a perspective view of the electrical connector in FIG. 1 in an assembled configuration;

FIGS. 3A–3C are perspective views respectively showing different interchangeable ferrules used in the electrical connector shown in FIG. 1;

DETAILED DESCRIPTION OF THE PREFERRED EMBODIMENT

Figure 1:
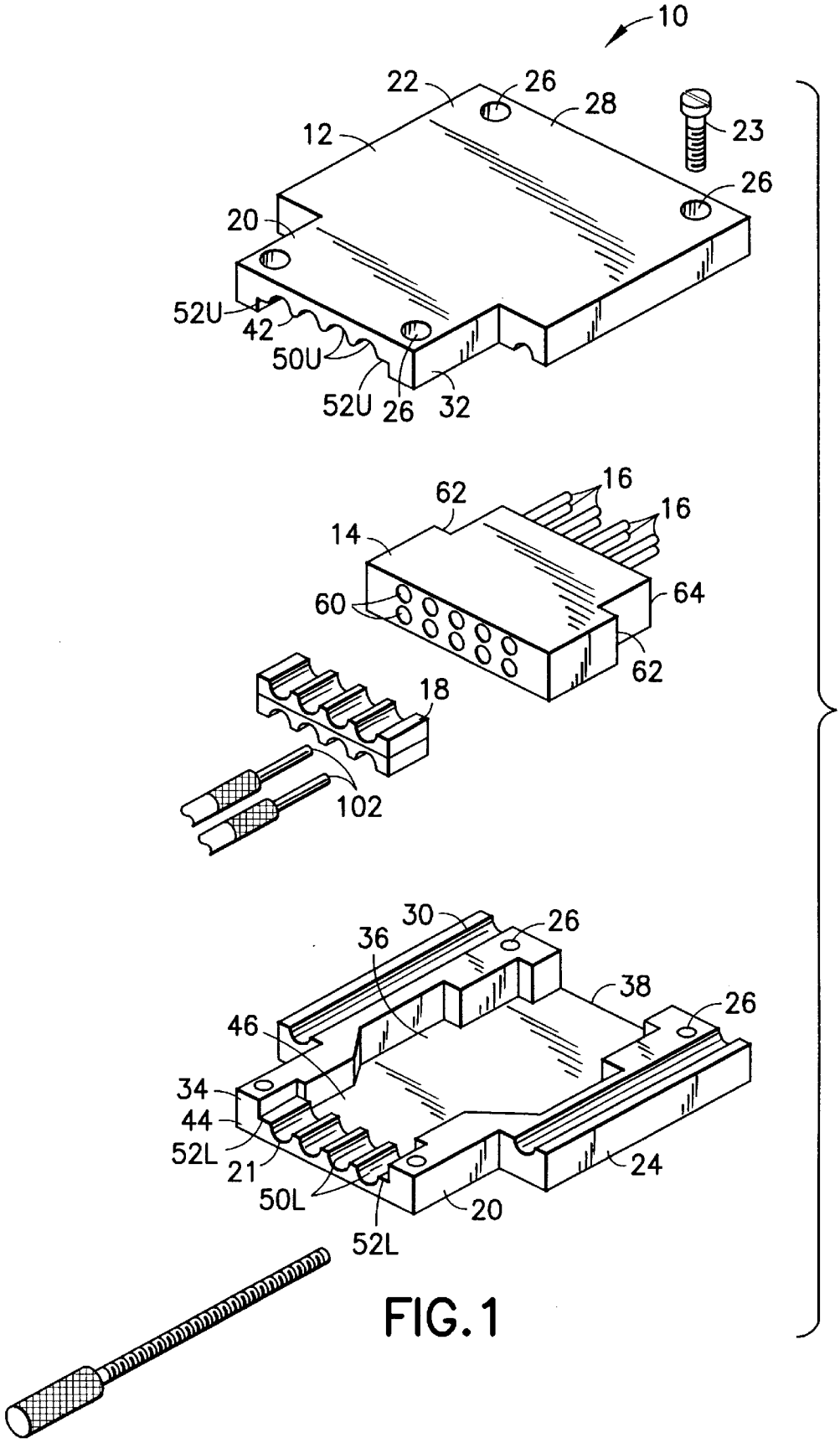
FIG. 1 is an exploded perspective view of an electrical connector incorporating features of the present invention in accordance with a first preferred embodiment of the present invention.

Referring to FIG. 1, there is shown an exploded perspective view of an electrical connector 10 incorporating features of the present invention. Although the present invention will be described with reference to the various embodiments shown in the drawings, it should be understood that the present invention can be embodied in many alternate forms of embodiments. In addition, any suitable size, shape or type of elements or materials could be used.

Still referring to FIG. 1, the electrical cable connector 10 generally comprises an outer or back shell 12 and a contact housing 14 holding electrical contacts 16. The contact housing 14 is located inside the back shell 12 when the connector 10 is assembled. Electrical cables or wires 100, such as for example, data transfer cables for connecting a computer to peripheral devices (not shown), terminate into contact housing 14. The electrical conductors 102 of each cable 100 can be directly connected to corresponding contacts 16 in the contact housing 14 or indirectly by using, for example, a printed circuit board (not shown) using known techniques. The electrical cable connector 10 includes a ferrule member 18 located in the cable exit portion 20 of the back shell 12. As shown in FIG. 2, the ferrule member 18 acts as a strain relief and holds the electrical cable 100 in the back shell 12 of the connector 10. The contacts 16 of electrical cable connector 10 may be mated to a complementing connector or port (not shown), for example, a suitable I/O port of a peripheral device, thereby connecting the cables 100 to the device. Likewise, the opposite end of cables 100 can have any suitable termination scheme.

The connector back shell 12 generally comprises an upper shell section 22 and a lower shell section 24. Each shell section 22,24 is preferably a one piece member made from a conductive material such as metal. In alternate embodiments, the upper and lower shell sections of the back shell may be made from a dielectric material such as any suitable plastic. The preferably hermaphroditic upper and lower sections 22, 24 of the back shell 12 are connected by suitable mechanical fasteners 23, such as for example, machine screws, inserted through holes 26 in one section 22,24 to threadably engage matching holes in the opposing section of the back shell. The upper and lower shell sections 22,24 have a general channel configuration. Each shell section 22,24 has a front part 28,30 and a rear part 32,34 depending from the front part. The front part 28,30 of the shell sections can be wider than the rear part 32,34. When the upper and lower shell sections 22,24 are assembled together, the front parts 22,30 define a chamber 36 which has a front opening 38. The rear parts 32,34 of the shell sections 22,24 form the cable exit section 20 of the back shell 12. The opening 42 at the rear end 44 of the back shell 12 communicates via the cable exit passage 46 with the chamber 36. The upper and lower shell sections preferably may have positioning features, such as seating surfaces and positioning grooves for locating and holding the connector housing 14 substantially fixed in the chamber 36. The upper and lower shell sections 22,24 may also be provided with suitable exterior flanges for movably holding threaded fasteners therein which are used for fastening the cable connector 10 to a mating port (not shown). In the rear part 32,34, each shell section 22,24 may have seating surfaces 21 which define a ferrule holding area 48 of the cable exit section 20 when the back shell 12 is assembled (see FIG. 2). As shown in FIG. 1, in the first preferred embodiment of the present invention, the ferrule holding area 48 has a predetermined number of channels 50U,50L formed therein. Though FIG. 1 shows four channels 50U,50L, the upper and lower shells may be provided with any suitable number of channels. Seating surfaces 52U,52L are preferably located on opposite sides of the channels 50U,50L for supporting ferrule 18.

Still referring to FIG. 1, the contact housing 14 is generally made from a suitable dielectric material such as plastic. The contact housing 14 generally has a predetermined number of channels 60 formed therein which holds suitable contacts 16 such as for example, pin contacts or receptacle contacts. The channels 60 and contacts 16 are disposed in the housing in a predetermined pattern and extend through the housing 14 allowing conductors 102 connected to corresponding contacts 16 to pass through the rear of the housing. The outer surface 62 of the contact housing 14 has surfaces complimenting the positioning features in the chamber 36 of the back shell 12 so that when the upper and lower shell sections 22,24 are assembled together around the contact housing 14, the contact housing 14 is fixedly held in the connector 10. The front 64 of the contact housing 14 can have polarizing features, such as for example, angled sides (not shown), to aid in aligning the connector 10 with a mating connector or port (not shown).

FIGS. 3A–3C show examples of different interchangeable ferrules 18A–18C which maybe used in accordance with the first preferred embodiment of the present invention to hold the cables 100 in the electrical cable connector 10. In FIGS. 3A–3C, similar parts are similarly numbered. The following description will generally refer to FIG. 3A unless otherwise indicated. In the preferred embodiment, the ferrule 18A comprises two substantially symmetrical parts 66A,68A which may be stacked back to back when the ferrule is installed in the back shell 12 of the connector 10. In alternate embodiments, the ferrules may be a one piece member as shown in FIG. 3C or may include any suitable number of sections. Each ferrule part 66A,68A generally has a center member 70A,72A which spans between side supports 74A, 75A. A predetermined number of cable holding grooves 76A,78A are formed in the center member 70A,72A. The cable holding grooves 76A,78A are located to align with the channels 50U,50L formed in the cable exit section 20 of the back shell.

As seen in FIGS. 3A–3C, the different interchangeable ferrules 18A–18C have different predetermined number of cable holding grooves to conform to different number of cables 100 exiting the connector. For example, one of the different ferrules 18A, maybe provided with eight grooves 76A,78A (four in the top ferrule part 66A and four in the bottom part 68A) corresponding to the total cables which may be accommodated in the cable exit section 20 of the preferred embodiment shown in FIG. 3A. A second one of the ferrules 18B, maybe provided with four grooves 76B, 78B in a symmetrical configuration as shown in FIG. 3B. In alternate embodiments, other ferrules may have any suitable number of cable holding grooves arranged in a symmetrical or unsymmetrical configuration (e.g. more grooves maybe located on the top than on the bottom or vice versa) conforming to the number and configuration of the cables held in the cable exit section of the connector. The depths and radius of the cable holding grooves 76A,78A,76B,78B, 76C,78C, may also vary between the different ferrules 18A–18C. By way of example, the depths of the grooves 76A,78A of ferrule 18A maybe sized to conform to the exterior of the given size cable 100 having an outer braided armor sheathing as shown in FIG. 1. Other ferrules 18B may have shallower grooves 76B,78B sized to accommodate non-armored cables of a given size. Preferably, different interchangeable ferrules (not shown) may be provided to accommodate different corresponding sizes of armored, or non-armored cables. The depths of the cable holding grooves 76A,78A, in ferrule 18A may also be different than the depth of the grooves 76B,78B in ferrule 18B in order to generate different strain relief forces on electrical cables 100.

Again by way of example, ferrule 18A has deeper grooves 76A,78A, and hence, generates smaller strain relief forces on cables 100 of a given size then ferrule 18B with shallower grooves 76B,78B as will be described in greater detail below. Furthermore, some interchangeable ferrules 18A, 18B, which may be used with the connector 10 may be made from a suitable conductive material such as steel, aluminum or copper alloy. Other interchangeable ferrules 18C may be made from a suitable dielectric material such as plastic.

Figure 4:
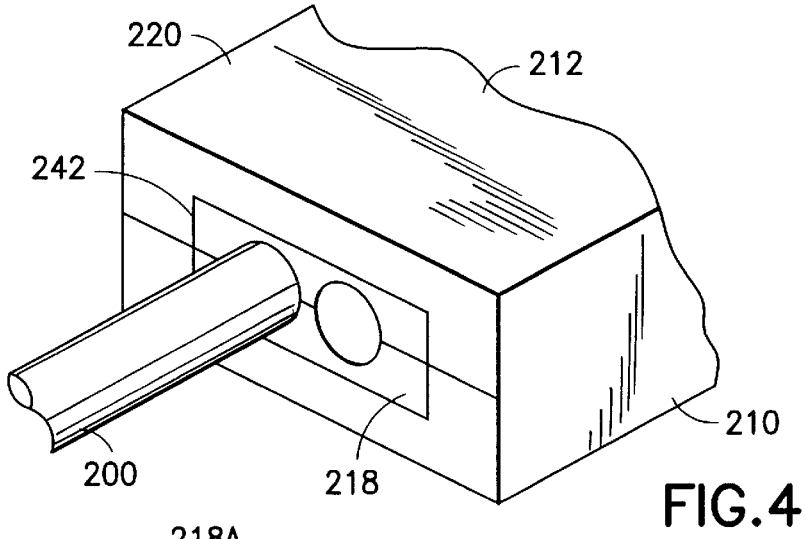
FIG. 4 is a partial perspective view of the electrical connector in FIG. 1 having a cable exit in accordance with a second preferred embodiment of the present invention.
Figure 5A:
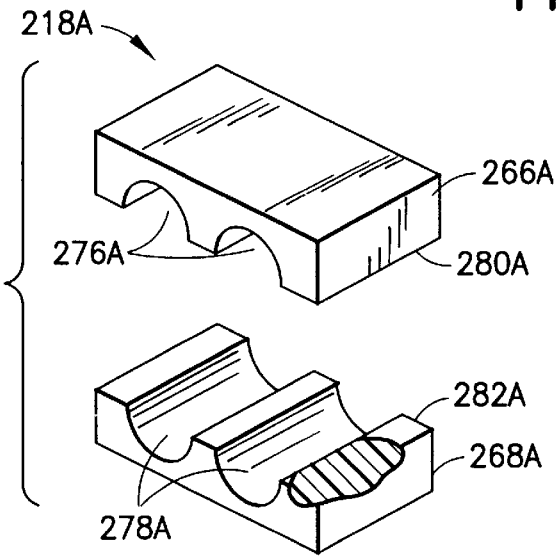
FIGS. 5A–5B are perspective views respectively showing different interchangeable ferrules used in the electrical connector shown in FIG. 4.
Figure 5B:
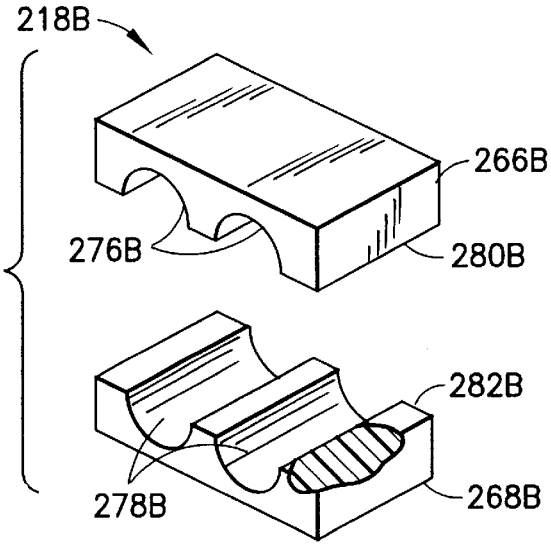

Referring now to FIG. 4, there is shown a partial perspective view of the cable exit section 220 of an electrical cable connector 210 in accordance with a second preferred embodiment of the present invention. Except as otherwise noted, the electrical cable connector 210 is substantially similar to the electrical cable connector 10 shown in FIGS. 1 and 2, with similar parts in FIG. 4 having similar numbers to those in FIGS. 1 and 2. The cable exit section 220 has a rear opening 242 to which electrical cables 200 exit the connector back shell 212. A ferrule is located in the rear opening 242 to hold the cables 200 and the back shell 212. The rear opening 242 in the cable exit section 220 preferably has a general rectangular shape, though the opening may have any other suitable shape. The sides of the opening 242 are substantially flat. FIGS. 5A–5B show examples of different interchangeable ferrules 218A,218B which may be used in the cable exit section 220 of connector 210. Clearly, connector 210 could use the same ferrules used in connector 10 described earlier, but placed in rear opening 242 in an opposite orientation. In this preferred embodiment, the different interchangeable ferrules 218A,218B comprise upper and lower symmetrical parts 266A,268A,266B,268B. The ferrules 218A,218B are sized to form a close forming fit with the rear opening 242 of the cable exit section 220. The upper and lower ferrule parts 266A,268A,266B,268B have cable holding grooves 276A,278A,276B,278B formed in an inner edge 280A,282A,280B,282B of the ferrule parts. The depths of the grooves in the different ferrules may be different to accommodate different sizes and types of cables (e.g. armored, or non-armored cables) or otherwise to generate different strain relief forces on cables of a given size. Other methods of adjusting strain relief are possible, such as providing projections (not shown) in the grooves. The different ferrules 218A,218B may also be made from metal or otherwise from non-conductive materials as shown.

Figure 6:
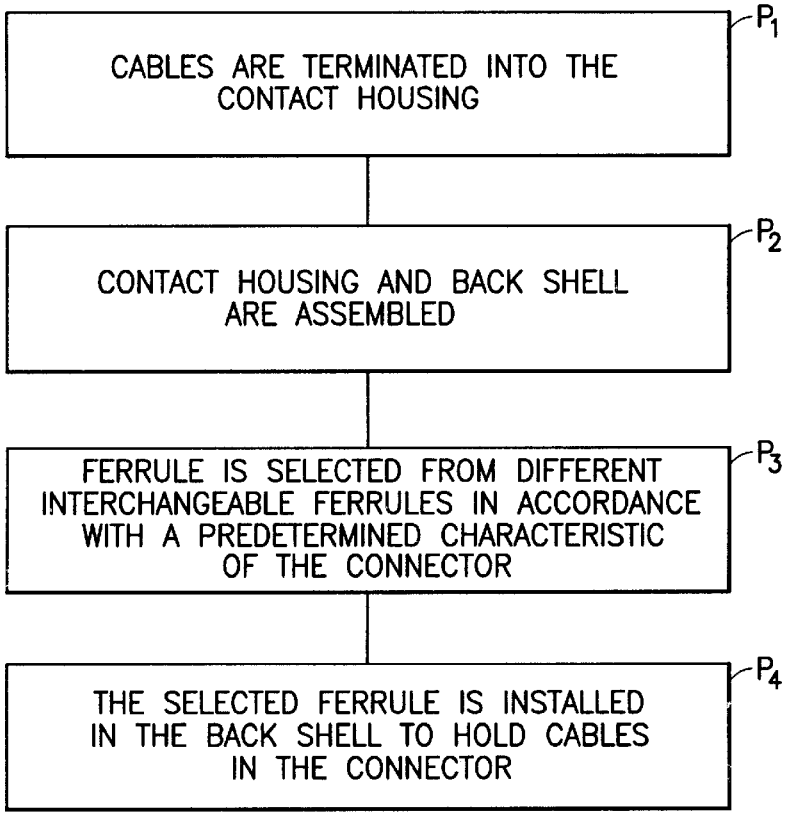
FIG. 6 is a flow chart pictorially depicting a method for manufacturing an electrical connector in accordance with the present invention.

Referring now to FIG. 6, there is shown a flow chart pictorially depicting a method for manufacturing the electrical cable connector 10 as described below. In block P1 of FIG. 6, the cables 100 are terminated in the contact housing 14 of the connector 10. Terminating the cables 100 to the housing 14 is generally performed by stripping the shielding (such as the outer braided sheathing for armored cables), and insulation on the cables 100 to expose the bare conductors 102 in the cables. The bare conductors 102 are connected by suitable means (such as crimping) to corresponding contacts, and the contacts are inserted into the channels in the contact housing 14 through the rear face of the housing. Other methods may be used for securing conductors 102 to the contacts, such as for example by using an insulation displacement contact. In block P2, the back shell 12 is assembled around the contact housing 14. The contact housing 14 is positioned inside one of the shell sections 22,24 with a front 64 of the contact housing facing towards the front opening 38 of the shell. The two shell sections 22,24 are then brought together to close the shell 12 around the contact housing 14. The cables 100 terminating in the contact housing 14 extend through the cable exit section 20 and exit the back shell 12 through the rear opening 42. In block P3 of FIG. 6, a ferrule 18A–18C is selected from the different interchangeable ferrules in accordance with a predetermined characteristic of the connector 10. By way of example, a ferrule is selected which has a suitable number of cable holding grooves corresponding to the number of cables 100 exiting the connector shell 12. In the case where eight cables 100 exit the shell, ferrule 18A with eight cable holding grooves 76A,78A may be selected in block P2. Furthermore, in the case where the connector 10 is an electrically shielded connector, such as when the connector has a back shell 12 which is grounded when the connector 10 is mated to a mating component or device, then a conductive ferrule 18A is selected in block P3. The conductive ferrule 18A may thus provide an EMI bridge, shorting the braided sheathing of the cables 100 to the back shell 12 of the connector 10 or other suitable component of connector 10. Alternatively, in the case where the cables 100 are to be isolated from the back shell 12 of the connector 10, then a ferrule 18C made of non-conductive material may be selected in block P3 of FIG. 6. In addition to the above, the ferrule is selected, in block P3, from the different interchangeable ferrules in order to provide sufficient strain relief forces on the cables 100 exiting the back shell 12. Accordingly, if higher strain relief forces are deemed desirable, then a ferrule having shallower cable holding grooves may be selected. Otherwise, if lower strain relief forces are deemed sufficient, then a ferrule 18A having deeper cable holding grooves 76A,78A may be selected. In block P4 of FIG. 6, the selected ferrule 18A is placed in the ferrule holding area between the back shell sections 22,24. Although blocks P3 and P4 are shown located below block P2 in FIG. 6, the steps associated with blocks P3 and P4 may be performed at any suitable time (e.g. concurrent with or prior to block P2) prior to clamping of the back shell 12 with fasteners 23 (see FIG. 1). Threading fasteners 23 draws the shell sections 22,24 together which compresses the selected ferrule 18A and cables 100 in the ferrule holding area together until the seating surfaces 80A,82A (see FIG. 2A) are seated against the corresponding shell sections 22,24 of the connector 10. In this position, the cables 100 exiting the shell 12 are clamped in the corresponding grooves 76A,78A of the ferrule 18A and grooves 50U,50L of the shell 12. The clamping action between ferrule 18A and shell 12 generates the strain relief forces on the cables 100 held by the ferrule 18A. The clamping action between ferrule 18A and shell 12 effects electrical contact between the braided sheathing of the cables 100, seated in the ferrule grooves 76A,78A, and the metal ferrule 18A. Furthermore, the clamping of the back shell section 22,24 against the sides supports 74A,76A effects an electrical connection between the ferrule 18A and the back shell 12. Hence, the ferrule 18A functions as an EMI bridge for the shielded connector 10.

The method of manufacture of the connector 210 (see FIG. 4) in accordance with the second preferred embodiment of the present invention is substantially the same as that described above and depicted in FIG. 6. The electrical cables 200 are terminated in the contact housing (not shown) in block P1, and in block P2, the contact housing is positioned in the back shell 212 with the cables terminating therein exiting the shell 212 through the cable exit section 220. In block P3, the desired ferrule 218A, 218B is selected from the different interchangeable ferrules to accommodate the number and configuration of cables 200 in the cable exit section 220, to provide the desired strain relief force on the cables 200, and electrically connect the cable sheathing to the shell or otherwise to isolate the cables 200 from the shell. As shown in FIG. 4, in this embodiment, the ferrule 218A is installed in the ferrule holding area 242 of the shell 212 with the cables 200 located between the upper and lower ferrule parts 266A,268A (block P4 of FIG. 6). When the back shell 212 is closed by threading the fasteners (not shown) connecting the upper and lower sections of the shell, the cables 200 are clamped in the holding grooves of the ferrule 218A. The clamping action generates the strain relief forces on the cables 200, effects electric contact between the braided sheathing on cables 200 and the metal ferrule 218A, and further effects electrical contact between the sides of the ferrule 218A and the shell 212.

The present invention provides an electrical cable connector 10,210 which incorporates an interchangeable ferrule 18A–18C, 218A–218B, for holding the cables 100,200 in the connector back shell 12,212. The interchangeable ferrule used in the electrical cable connector corresponds to one or more characteristics of the connector 10,210 such as for example, the arrangement and size of cables 100,200 exiting the back shell, the strain relief to be provided by the connector to the cables 100,200, and any electrical shielding to be provided by the back shell. Correspondingly, in the present invention, components of the connector 10,210 such as the back shell 12,212, may have a configuration which is common among the connectors 10,210 of the present invention, however, the connectors 10,210 may accommodate different cable exit configurations by using an appropriate ferrule from the different interchangeable ferrules 18A–18C, 218A–218B. Hence, in the present invention, a common back shell 12,212 may be used in connectors with many different cable exit configurations. This maximizes commonality between the connectors 10,210 of the present invention while maintaining flexibility and multifunctionality of the connectors which leads to savings in labor, time, and cost in the manufacture and installation of the connectors 10,210 on electrical cables 100,200. By comparison, with conventional connectors, different back shells are used for different cable exit configurations even though the connectors may otherwise be substantially similar. Accordingly, in conventional connectors, different back shells are manufactured for substantially the same electrical cable connector. This lack of commonality between conventional connectors which are basically the same except for variances in the cable exit section results in increased manufacturing costs as different tooling is used to produce the different back shells. Furthermore, the manufacture of different back shells is significantly more costly than merely manufacturing different ferrules as in the present invention to be used with a common back shell. The present invention provides a connector having a lower cost with greater flexibility and multifunctionality in comparison to conventional connectors.

Figure 7:
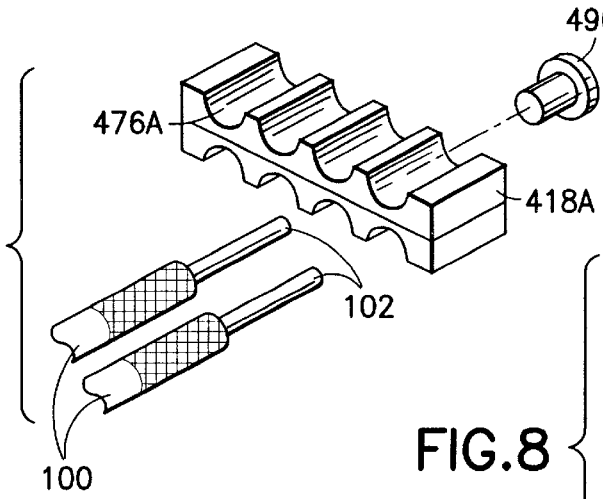
FIGS. 7–8 are perspective views showing ferrules of the electrical connector in accordance with further embodiments of the present invention.
Figure 8:
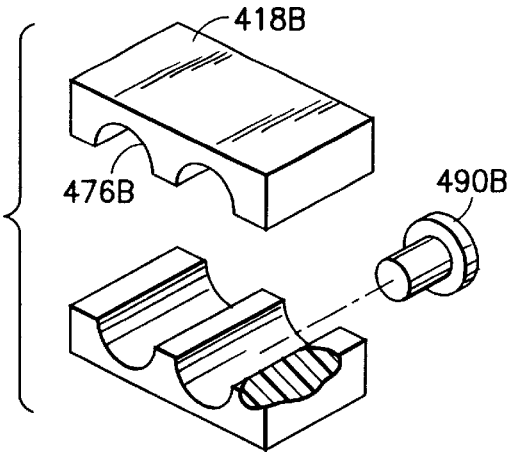

In order to further reduce the number of parts required to manufacture various connectors, FIGS. 7 and 8 demonstrate another alternative embodiment of the present invention. Rather than having ferrules each with different numbers of grooves, a ferrule 418A,418B is used with a predetermined number of grooves 476A,476B (typically the maximum number of cables/wires used in any connector). Should the specific application require less wires/cables, then a plug 490A,490B is used to seal the unused groove. Plug 490 can have a body with a size similar to the wire/cable. Plug 490A,490B can also have an enlarged head to prevent plug 490A,490B from exiting the unused groove. Plug 490A, 490B can be made from suitable material, either conductive or non-conductive.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for manufacturing an electrical connector, the method comprising the steps of:

providing an electrical connector shell having a chamber for holding an electrical contact housing therein, the shell having a cable exit section allowing an electrical cable terminating in the electrical contact housing to exit the shell through the cable exit section;

providing different ferrules for use with the electrical connector shell, the different ferrules having different predetermined characteristics; and selecting a ferrule, from the different ferrules, to be placed in the cable exit section of the shell;

wherein the selected ferrule has a predetermined characteristic corresponding to a predetermined characteristic of the electrical connector; and selecting a plug for plugging a cable locating groove in the selected ferrule.

2. A method in accordance with claim 1, wherein the predetermined characteristic of the electrical connector is that a number of the electrical cables exit the shell through the cable exit section of the shell, the selected ferrule having cable locating grooves corresponding to the number of electrical cables exiting the shell.

3. A method in accordance with claim 1, wherein the predetermined characteristic of the electrical connector is that the electrical connector is an electrically shielded connector.

4. A method in accordance with claim 1, wherein the predetermined characteristic of the electrical connector is that a shield of the electrical cable is electrically isolated from the electrical connector shell.

5. A method in accordance with claim 1, wherein the selected ferrule is a strain relief ferrule.

6. A method in accordance with claim 1, wherein the different ferrules include different strain relief ferrules for generating strain relief forces on the electrical cable, different ones of the strain relief ferrules generating different strain relief forces when placed in the cable exit section of the shell, and wherein the selected ferrule is selected from the different strain relief ferrules to provide a selected predetermined strain relief on the electrical cable in the cable exit section of the shell.

7. A method in accordance with claim 6, wherein different ones of the strain relief ferrules have at least one channel formed therein for holding the electrical cable, the channels in corresponding ones of the different strain relief ferrules having different depths so that different ones of the strain relief ferrules generate different strain relief forces on the electrical cable when placed in the cable exit section of the shell.

8. In an electrical connector comprising a shell having a chamber with a contact housing disposed therein, the contact housing being adapted for terminating a conductor of a cable connected to the shell, the shell having a cable exit section through which the cable exits the shell, wherein the improvement comprises:

the electrical connector having an interchangeable ferrule part held in the cable exit section of the shell, the interchangeable ferrule part being interchangeable with different interchangeable ferrule parts for the connector, the different interchangeable ferrule parts being used for different cable exit configurations of the connector; and the connector has a plug for plugging a cable locating groove in the interchangeable ferrule part held in the cable exit section of the shell.

9. An electrical connector in accordance with claim 8, wherein the different interchangeable ferrule parts include at least one of a strain relief ferrule part, a single cable exit ferrule part, a multiple cable exit ferrule part, a conductive ferrule part, or a non-conductive ferrule part.

10. An electrical connector in accordance with claim 8, wherein the different interchangeable ferrule parts include an interchangeable ferrule part made from a conductive material for an electrically shielded cable exit configuration, and an interchangeable ferrule part made from a non-conductive material for a cable exit configuration wherein the cable exiting the shell is held in the cable exit section so that a shield of the cable is electrically isolated from the shell.

11. An electrical connector in accordance with claim 9, wherein the different interchangeable ferrule parts include an interchangeable ferrule part comprising a lower ferrule section and an upper ferrule section, wherein the cable exiting the shell is located between the upper and lower ferrule sections.

12. An electrical connector in accordance with claim 9, wherein the cable exit section is located at a back end of the shell, and at least one of the different cable exit configurations includes multiple cables exiting through the cable exit section from the back of the shell.

13. An electrical connector in accordance with claim 9, wherein each of the different interchangeable ferrule parts has at least one opening for holding therein the electrical cable exiting the shell, the different interchangeable ferrule parts including at least one ferrule part with an opening having a size different than an opening of a second ferrule part, wherein when the first ferrule part is held in the cable exit section the first ferrule part generates a strain relief force on the cable exiting the shell different than a strain relief force on the cable when the second ferrule part is held in the cable exit section of the connector.

14. An electrical connector in accordance with claim 8, wherein the different interchangeable ferrule parts include an interchangeable ferrule part comprising a one piece ferrule, wherein the cable exiting the shell is located between the ferrule and the shell.

15. An electrical connector comprising:

an outer shell;

an electrical contact housing located in the outer shell at a connecting end of the outer shell, the shell having a cable exit section at a back end of the shell wherein an electrical cable terminating in the electrical contact housing exits the shell through the cable exit section;

a ferrule part held in the cable exit section of the shell, the ferrule part held in the cable exit section being selected from different ferrule parts in accordance with a predetermined characteristic of the electrical connector; and a plug for plugging a cable locating groove in the ferrule part held in the cable exit section of the shell.

16. An electrical connector in accordance with claim 15, wherein the predetermined characteristic of the electrical connector is that the electrical connector is a shielded connector.

17. An electrical connector in accordance with claim 15, wherein the predetermined characteristic of the electrical connector is that the cable is held in the cable exit section so that a shield of the cable is electrically isolated from the shell of the connector.

18. An electrical connector in accordance with claim 15, wherein the predetermined characteristic is that the connector has a number of electrical cables exiting the shell through the cable exit section, the ferrule part held in the cable exit section having cable locating grooves at least corresponding to the number of electrical cables exiting the shell.

19. An electrical connector in accordance with claim 18, wherein the shell has cable locating grooves, so that corresponding cable locating grooves in the shell and cable locating grooves in the ferrule part receive an electrical cable therebetween.

20. An electrical connector in accordance with claim 18, wherein the ferrule part comprises an upper ferrule section and a lower ferrule section, so that corresponding cable locating grooves in the upper ferrule section and cable locating grooves in the lower ferrule section receive an electrical cable therebetween.

21. An electrical connector in accordance with claim 18, wherein the number of cable locating grooves exceeds the number of electrical cables exiting the shell, resulting in at least one unused cable locating groove, the electrical connector further comprising a plug inserted into each of the unused cable locating grooves to fill the unused cable locating groove.

22. A kit, comprising:

an electrical connector, the electrical connector having:

a shell having an opening therein adapted to receive a ferrule;

a plurality of contacts in said shell;

at least one cable having wires connected to said contacts, said cable exiting said shell at said opening;

a plurality of ferrules, each mountable in said opening and adapted to provide a different predetermined characteristic to said connector; and at least one plug for plugging a cable locating groove of one of the plurality of ferrules when the one of the plurality of ferrules is mounted in said opening.

* * * * *